United States Patent [19]

Berg et al.

[11] Patent Number: 4,946,339

[45] Date of Patent: Aug. 7, 1990

[54] METHOD FOR THE EMPTYING OF A PACKAGE BAND AND AN ARRANGEMENT FOR IT

[75] Inventors: Sven-Olof Berg, Haverdal; Ingemar Broden, Halmstad; Odvan Johansen, Partille, all of Sweden

[73] Assignees: Pronova AB, Halmstad; Aktiebolaget SKF, Goteborg, both of Sweden

[21] Appl. No.: 217,363

[22] Filed: Jul. 11, 1988

[30] Foreign Application Priority Data

Jul. 13, 1987 [SE] Sweden ..... 8702839

[51] Int. Cl.[5] ..... B65B 69/00

[52] U.S. Cl. ..... 414/786; 414/412; 414/417; 414/403; 53/381 R; 83/409; 83/436

[58] Field of Search ..... 414/403, 411, 412, 416, 414/417, 786, 492, 381 R; 83/409, 435.1, 401, 436

[56] References Cited

U.S. PATENT DOCUMENTS

| | | | |
|---|---|---|---|
| 2,806,614 | 9/1957 | Butz | 414/417 |
| 3,116,718 | 1/1964 | Krupotich et al. | 414/412 X |
| 3,142,074 | 7/1964 | Reich . | |
| 3,260,404 | 7/1965 | Critcheil . | |
| 3,686,820 | 8/1972 | Zenger et al. | 414/412 X |
| 3,744,214 | 2/1973 | Dolce et al. | 414/412 X |
| 3,889,442 | 6/1975 | Grahn et al. | 414/412 X |
| 4,008,657 | 2/1977 | Yamamura et al. | 414/412 X |
| 4,428,709 | 1/1984 | Peters | 53/381 R X |
| 4,457,123 | 7/1984 | Hoehn | 414/412 X |
| 4,768,915 | 9/1988 | Fujioka | 414/403 X |

FOREIGN PATENT DOCUMENTS

| | | | |
|---|---|---|---|
| 1923020 | 5/1968 | Fed. Rep. of Germany . | |
| 7105639 | 2/1971 | France . | |
| 2067155 | 4/1981 | United Kingdom | 414/412 |

*Primary Examiner*—Frank E. Werner
*Attorney, Agent, or Firm*—Ladas & Parry

[57] ABSTRACT

An arrangement for the discharge of goods (50) from a package band (24) of flexible plastic material comprises a discharge board (60). The package band is provided with pockets (16) placed following one another and is moved along the discharge board so as to place the pockets in positions where a discharging device (71) moves a pusher roll (74) towards a receiving table (82). The pusher roll rests against the outer wall (**11*b*) of the package band and pushes the goods (50) out of pockets (16) of the package band. A retaining device (64) is situated inside a tunnel (18) of the package band and holds the same in place while the pusher roll discharges the goods to the receiving table (82**).

11 Claims, 8 Drawing Sheets

13
14
16a
16b
17a
17b
18
23
30
40a
40b
50a
50b
50c
50d
50e
V

METHOD FOR THE EMPTYING OF A PACKAGE BAND AND AN ARRANGEMENT FOR IT

FIELD OF THE INVENTION

The present invention relates to a method for the removing of goods from a package and to apparatus for carrying out the method.

BACKGROUND

There is a need in industry context for making it possible in manufacturing processes to move components and/or parts to a certain position from which they can be picked up in each individual phase of assembly in order to be fitted to equipment in the course of manufacture. It is necessary in certain applications for the components or parts prior to assembly to be protected from contamination and pollution as long as possible. It is also desirable for the parts which are to be assembled to be removed from packages by mechanical means and to be made accessible in batches, the number of parts included in each batch having to correspond to the number which is to be assembled in each individual phase of assembly. It is desirable, moreover, in certain assembly operations for the components or parts, after they have been removed from the packages, to be mutually in order and position so that e.g. a robot can be adjusted in order to pick up the parts and assemble them.

SUMMARY OF THE INVENTION

The present invention provides a method and an arrangement which fulfill the needs and demands set forth above. It is a particularly valuable feature of the present invention that it makes possible a simple and rational opening and discharging of components and/or parts from packages and in addition to this a simple adapting of the discharge of the components or parts in accordance with the working phase occurring at the particular assembling station.

BRIEF DESCRIPTION OF THE FIGURES OF THE DRAWING

The invention is described in greater detail in connection with the drawing wherein.

DETAILED DESCRIPTION OF PREFERRED EMBODIMENTS

Figure 1:
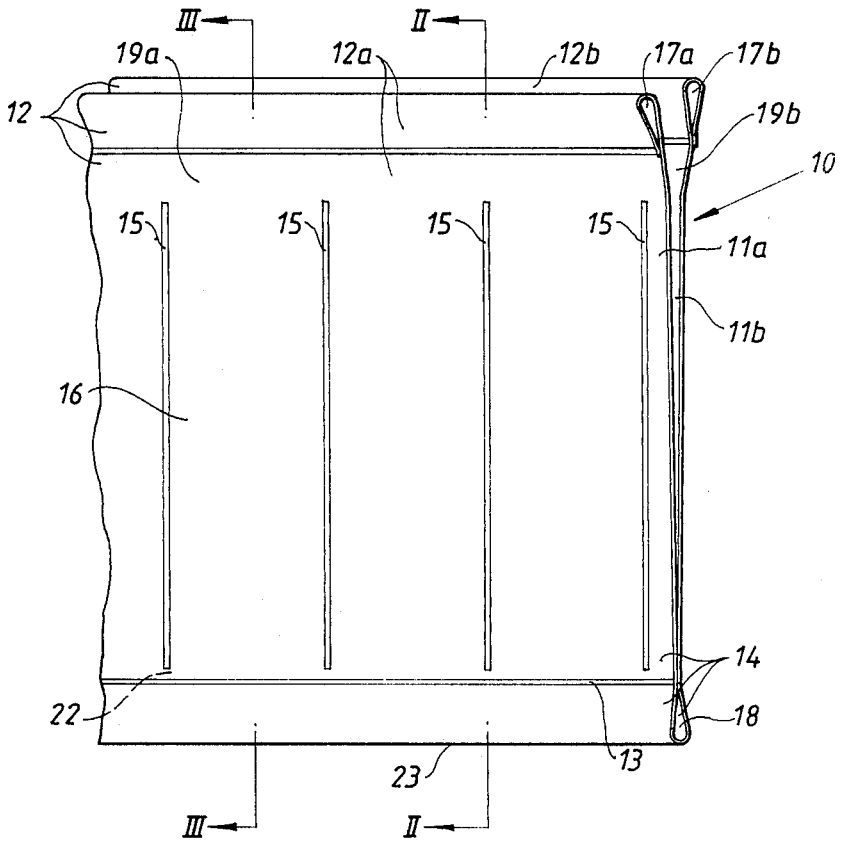
FIG. 1 is a perspective view of a portion of a package band.
Figure 2:
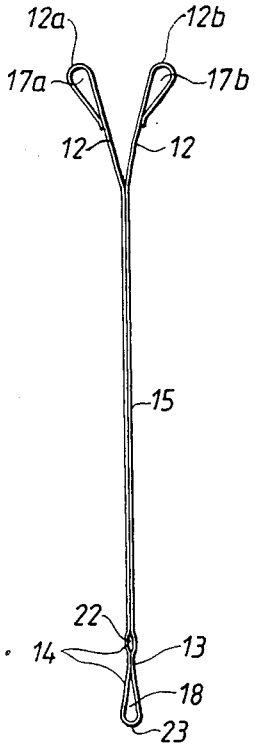
FIG. 2 is a section taken along line II—II in FIG. 1.
Figure 3:
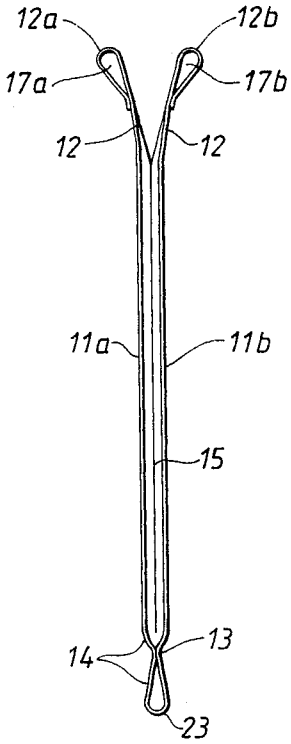
FIG. 3 is a section taken along line III—III in FIG. 1.

In FIGS. 1–3 represented an embodiment of a package band 10 formed of a band of flexible material, generally plastic material. The band of flexible material has been folded over so that two walls 11*a*, 11*b* placed substantially adjoining one another are formed, referred to hereinafter generally as first wall 11*a* and second wall 11*b* respectively. Each one of the walls has a first edge area 12*a* and 12*b* respectively. These two edge areas together form the first edge area 12 of the package band. Each one of the first edge areas 12*a* and 12*b* of the walls is provided with a connecting means 17*a*, 17*b* which in the figures is in the form of a tunnel 17*a*, 17*b*. At a second edge area 14 of the package band the two walls blend into one another in a transition 23.

A joint 13 provided in the longitudinal direction of the band fixes the walls to one another in an area inside of, and parallel to, the transition 23 of the band. As a result a tunnel 18 is formed between the joint 13 and the transition 23, which constitutes a second connecting element 18 on the package band. Substantially transversely to the longitudinal direction of the band joints 15 are provided parallel with one another, which fix the two walls 11*a*, 11*b* to one another and are joined to, or substantially reach as far as, the joint 13 arranged in the longitudinal direction of the band. The joints 13 and 15 thus delimit a number of pockets 16 arranged following one another in the longitudinal direction of the band which are oriented transversely to the longitudinal direction of the band. The joints referred to above are realized e.g. as welded or bonded joints.

The joints 15 situated transversely to the band terminate before they reach the connecting means 17*a*, 17*b* of the respective wall 11*a*, 11*b*. As a result a striplike area 19*a*, 19*b* is formed in the longitudinal direction of the band on each of the walls where these are not fixed to one another. This means that in an area comprising the striplike area just mentioned and the connecting elements 17*a*, 17*b* in the first edge area 12 of the package band, the walls can be moved away from one another so as to facilitate access to the pockets 16.

In certain embodiments the distance between the longitudinal joint 13 provided in the second edge area 14 and the end of the transverse joints 15 closest to the joint is chosen so that between the joints 15 and the joint 13 openings 22 are formed of a size adapted to the dimensions of a mechanical means e.g. an arm or a finger, forming part of an emptying equipment for the discharge of goods stored in the pockets 16. The joint 13 consequently represents an alternative embodiment of the second connecting means 18.

Figures 4A, 4B, 4C, 4D, 4E:
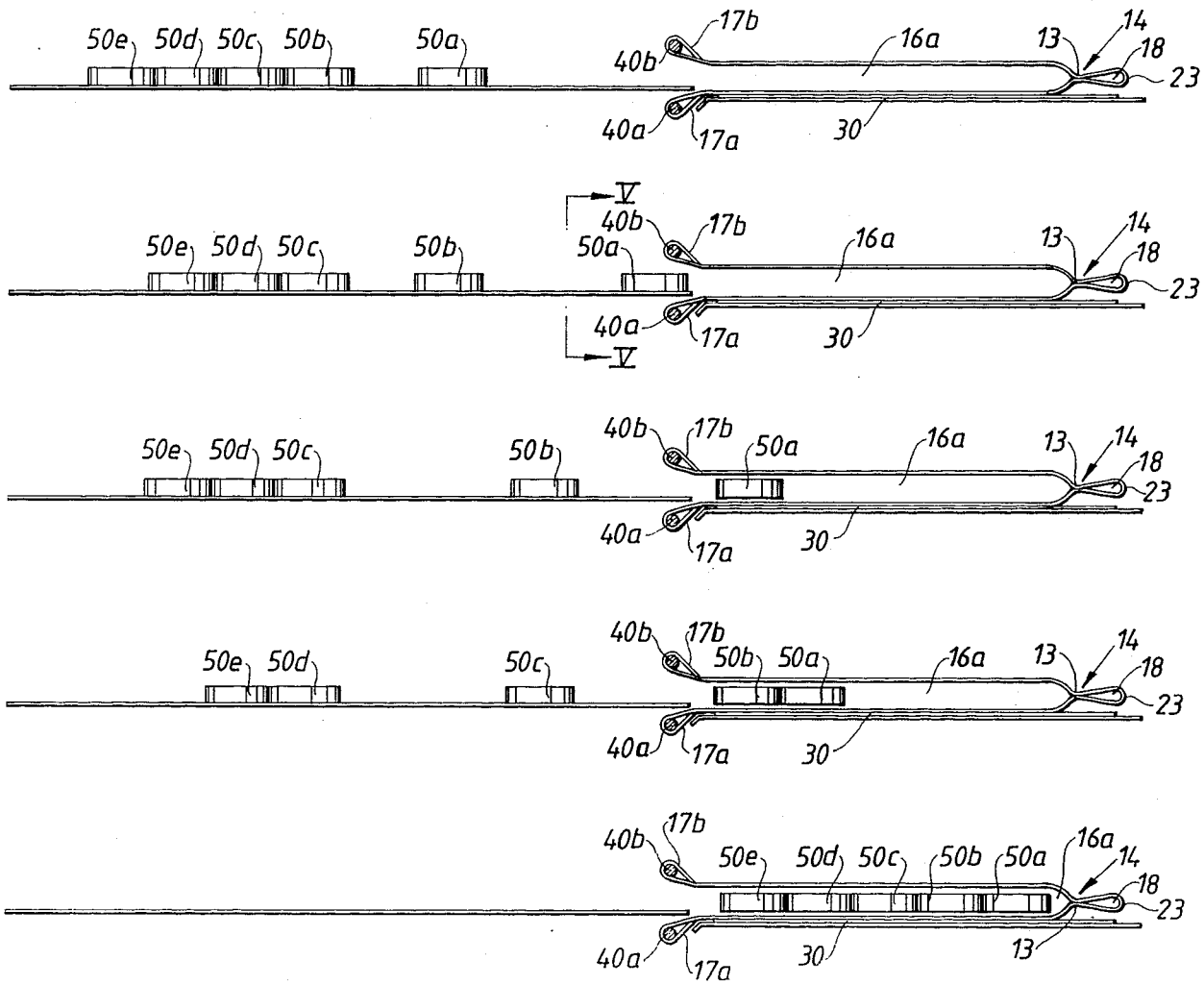
FIGS. 4*a–f* are schematic representations of the stepwise introduction of goods (components and/or parts) into a pocket in the package band.
Figure 4F:
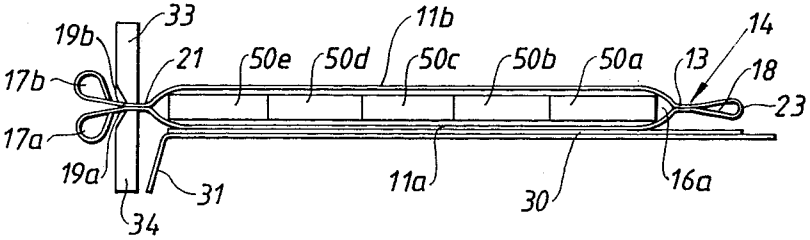
Figure 5:
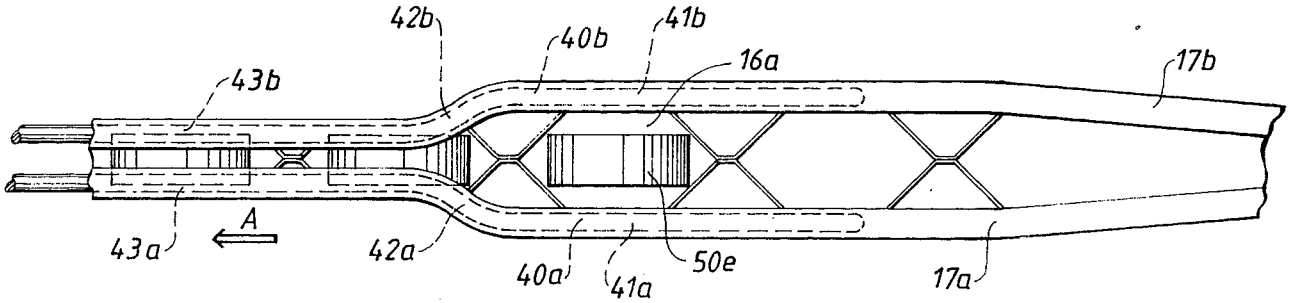
FIG. 5 is a schematic view of the package band including an arrangement for the feeding of goods into the pockets of the package band as seen in the direction of section V—V in FIG. 4*b*.

In FIGS. 4*a–f* and in FIG. 5 is shown an example of a technique for the feeding of goods into the pockets 16 of the package band. In FIGS. 4*a–f* are shown sectional views of the package band corresponding to the section III—III in FIG. 2 during different stages of the feeding of goods into one of the pockets 16*a*. The goods are represented in this instance by the items 50*a*–50*e*. For the feeding in of the goods a feeding board 30 is provided, which in a preferred application, may be in the form of a belt conveyor with a direction of movement transversely to the plane of projection. FIGS. 4*a–e* correspond to the position of the package band as shown in FIG. 5 whilst FIG. 4*f* corresponds to the position of the package band when it has moved one or more steps to the left of that shown in FIG. 5 so as to make possible the closure of the pocket 16*a* filled with goods and the feeding of goods into a subsequent pocket. FIG. 4*f* also shows how in certain applications the transport band of the belt conveyor in this area and/or the board has a bent-off part 31 so as to make room for welding dies 33, 34 by means of which the two walls of the package band are fused together and are fastened so as to provide a closure of the pocket filled with the goods. In a preferred embodiment the welding dies are designed so as to sever at the same time the connecting means 17*a*, 17*b* along with, as a rule, adjoining parts of the striplike area 19*a*, 19*b* from the closed band.

In FIGS. 4–5 are shown forkshaped format arms 40*a*, 40*b* which are engaged in the connecting means 17*a*, 17*b* designed as tunnels of the walls 11*a*, 11*b* in the first edge area 12. Each one of the format arms comprises a first portion 41, 41*b* which via a transition portion 42*a*, 42*b* passes over into a second portion 43*a*, 43*b*. The format arms in their first portions are spaced at a distance from one another whilst in their second portions they are located adjacent to one another. The package band is moved in the direction of the arrow A (FIG. 5) by means not shown in the Figure. The first portions of the format arms keep the connecting means 17*a*, 17*b* of the walls 11*a*, 11*b* away from one another as a result of which the pocket or pockets 16 which are in the corresponding part of the package band become accessible to allow feeding in of goods. FIGS. 4*a–f* show schematically how in this position items 50*a*–50*e* are successively moved into the pocket 16*a*.

The feeding in takes place either purely manually or with the help of a device not shown in the Figures which preferably pushes the items in piece by piece. A succeeding item then pushes an item already inserted towards the bottom of the pocket so that when all items have been delivered they occupy a position corresponding to that which is shown in FIG. 4*e*. Naturally the package band may have a vertical orientation, with the items dropping into the pocket.

Figure 6:
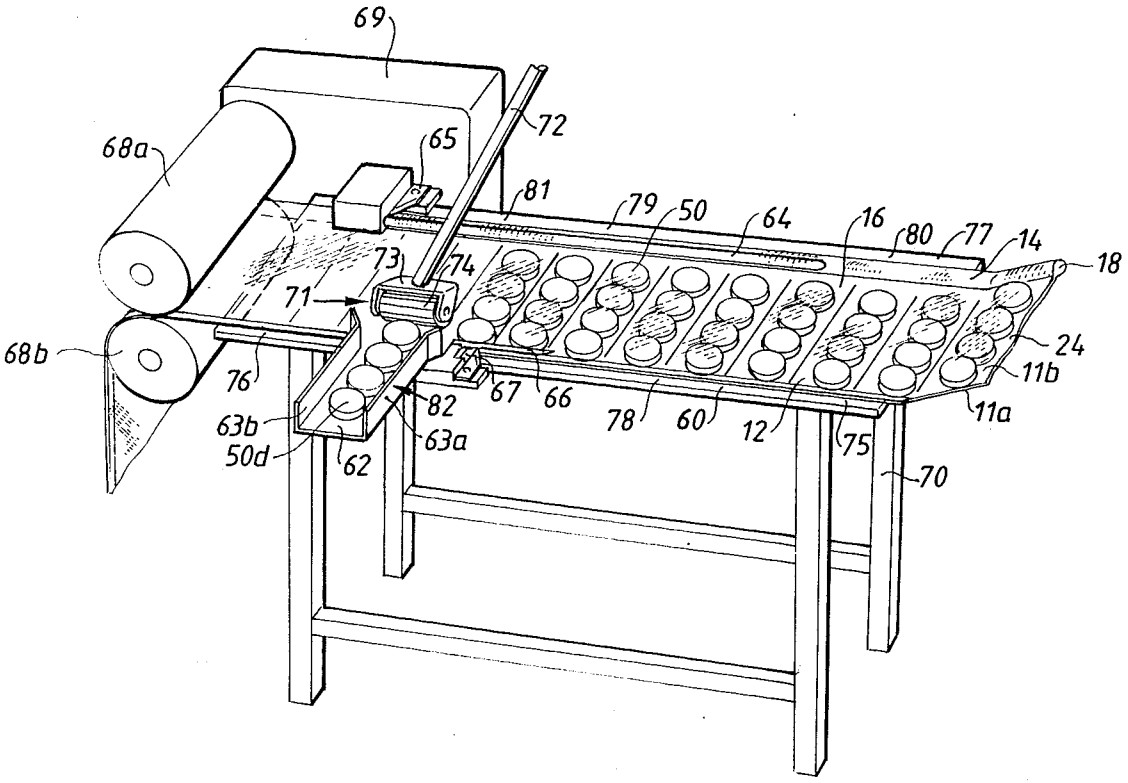
FIG. 6 is a perspective view of an arrangement for the discharging of goods from the package band filled with goods.
Figure 7:
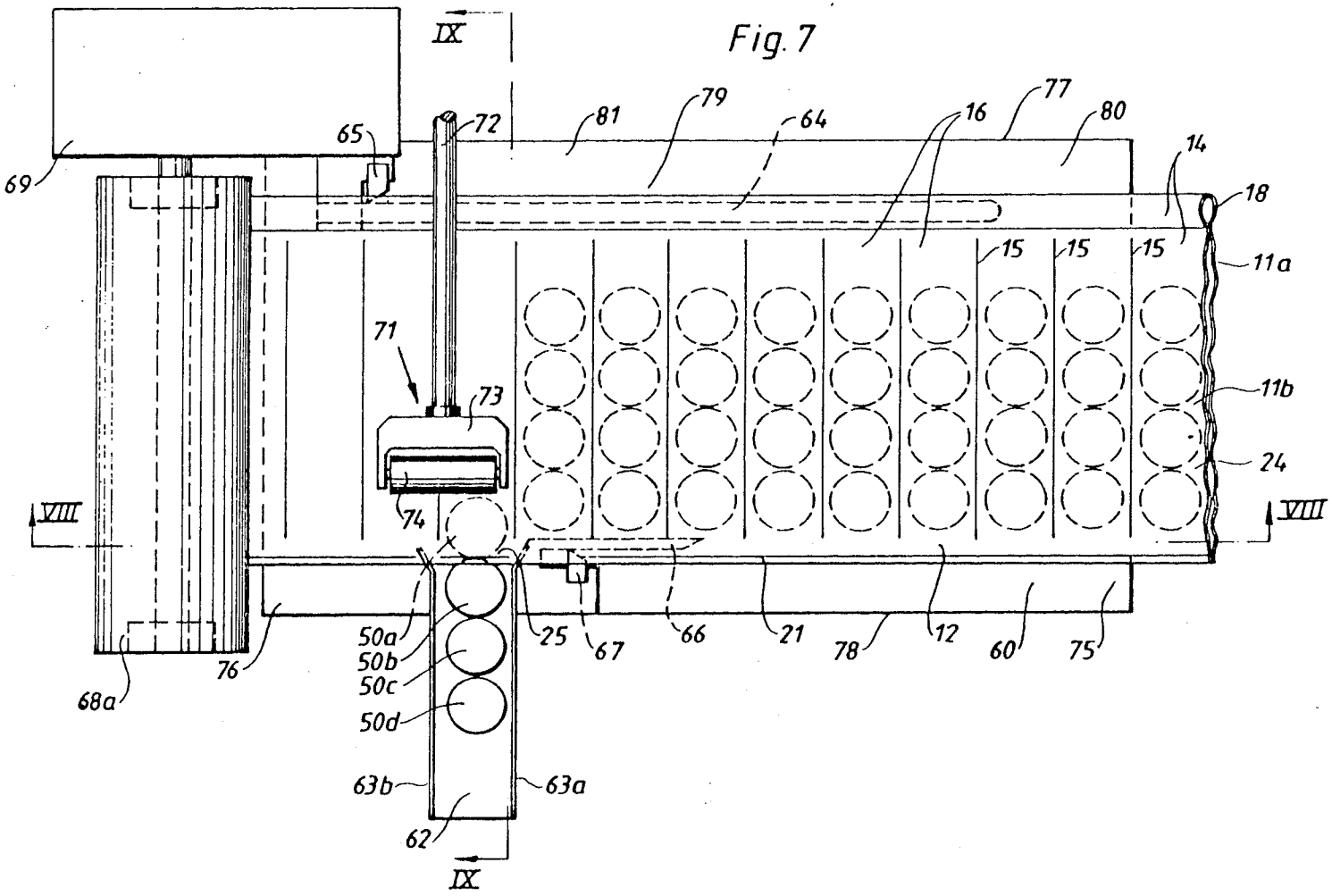
FIG. 7 is a view from above of the arrangement in accordance with FIG. 6 including a package band filled with goods.
Figure 8:
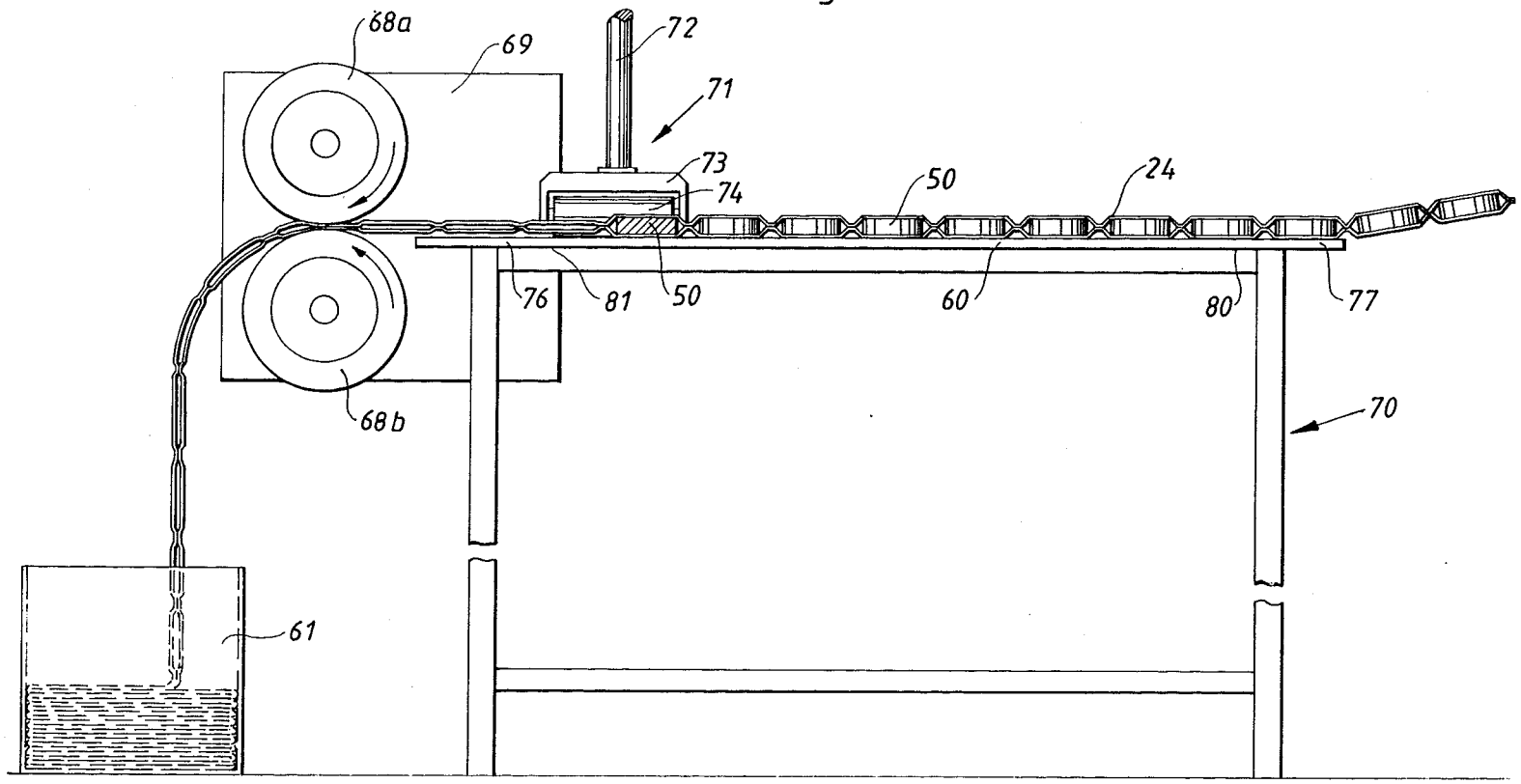
FIG. 8 is a section taken on line VIII—VIII in FIG. 7
Figure 9:
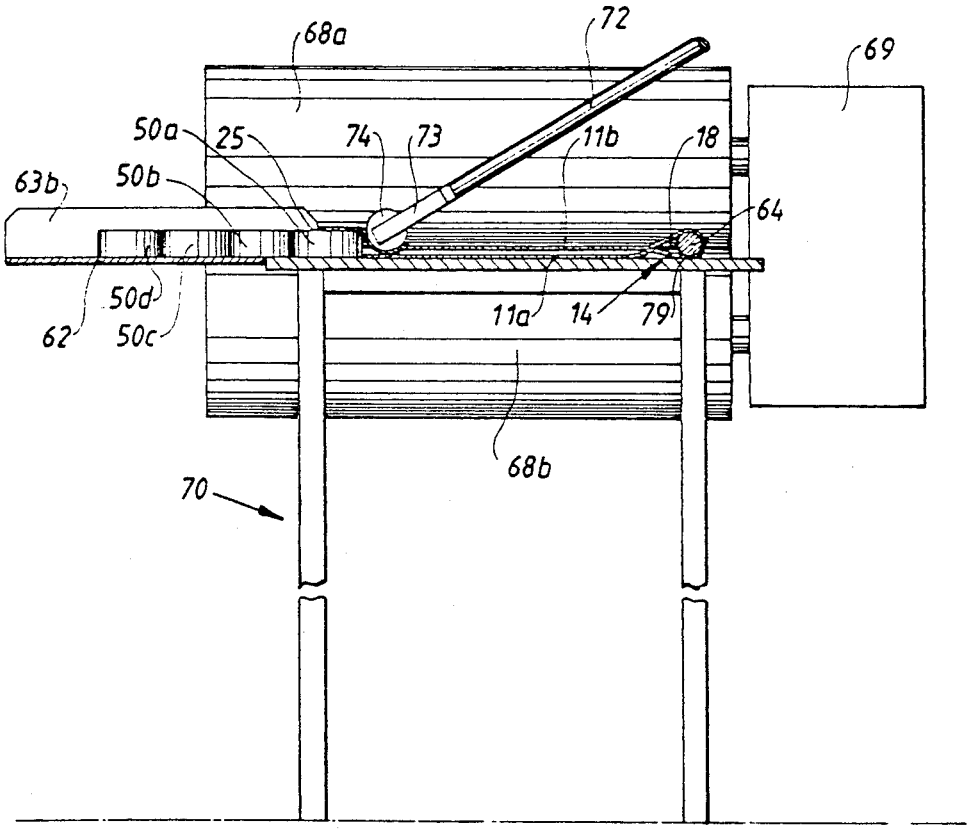
FIG. 9 is a section taken on line IX—IX in FIG. 7.

Subsequently the package band is moved one or more steps towards the left in FIG. 5 and the pocket 16*a* provided with goods is closed by welding means 33, 34 so that a joint 21 is formed between the walls, and at the same time the connecting means 17*a*, 17*b* in the first edge area of the respective walls, and in certain applications also adjoining parts of the striplike area 19*a*, 19*b*, are severed from the package band whilst a succeeding pocket 16 in the band occupies the position where goods are supplied to it. In the description which follows the reference designation 24 will be used for a package band filled with goods (see FIG. 6).

In FIGS. 6–9 is shown an embodiment of an arrangement for the discharge of goods present in pockets 16 of the package band 24. The discharge arrangement comprises a stand 70 which supports a base 60, hereinafter referred to as discharge base 60. This as a rule is constituted of a rectangular board or of a conveyor belt: Especially in applications where the arrangement is intended to handle package bands containing heavy goods the use of a conveying belt as a discharge base is preferred. The discharge base on the one hand has a first end area 75, situated in the feeding-in part 80 of the arrangement, for the package band filled with goods, and on the other hand it has a second end area 76 which is situated in the discharge part 81 of the arrangement. The package band is moved from the first end area of the discharge base to its second end area in order to allow a discharging device 71 at an intermediate work station to remove goods 50 from pockets 16 of the package band.

The arrangement includes a retaining means 64 which in the embodiments illustrated in the Figures is in the form of an arm located at a small distance from the boundary surface 79 of the discharge base 60 and adjoining a first edge area 77 of the discharge base. A first cutting means 65 is provided following the retaining means 64 and located in an area substantially between the discharging device 71 and the second end area 76 of the discharge base or located in this end area. In an area close to, and as a rule following, a second edge area 78 of the discharge base and at a small distance from its boundary surface 79 is provided a front retaining and control means 66, hereinafter called a control means. A receiving means 82 for goods discharged from the package band is provided following the second edge area 78 of the discharge base or is formed by a part of the latter. The receiving means is located in the area of the discharging device 71 so as to co-operate with the discharging device during the discharge of goods from the package band.

In a preferred embodiment, the receiving means is designed as a receiving board or track 62 according to the embodiments illustrated in the Figures. The receiving track is oriented substantially at right angles to the direction of movement of the package band and connects to the second edge area 78 of the discharge base 60. Along at least one of its lateral edges the track 62 is delimited by a chute wall 63*a*, 63*b*. A second cutting means 67 is provided in association with the front control means 66 and is located in an area which precedes the area for the receiving board 62 when the package band travels from the first end area 75 of the discharge base to the second end area 76 of the discharge base. The front control means 66 is also located in an area which precedes the area of the receiving means 82.

The figures illustrate the manner in which the discharging device 71 is arranged so that it can move substantially transversely to the direction of travel of the packing belt and in a direction towards and away from the receiving board 62. The discharging device according to the embodiment shown includes an arm 72 connected with a fork 73 wherein is supported a contact means 74 which is constituted of a pusher roll 74. On displacement of the discharging device in the direction towards the receiving board the pusher roll travels along the discharge base 60. The discharging device comprises a spring which maintains the pusher roll pressed against the base which during the discharge of the goods is constituted of the second wall 11*b* of the package band.

In the figures is shown an embodiment of the arrangement where a transporting means 68*a*, 68*b* for the movement of the package band is arranged following the second end area 76 of the discharge base. The transporting means in the embodiment shown is constituted of two rotating rolls placed substantially on top of one another with matching direction of rotation in the area where the circumferential surfaces of the rolls are located closest to one another. The rolls are supported in one or several motor and bearing housings 69.

When using the band in accordance with the invention the goods are inserted into pockets 16 of the band in that the format arms 40*a*, 40*b* (see FIG. 5) are introduced into the respective connecting means 17*a*, 17*b*, whereupon the belt is moved by transporting means (not shown in the figures) along the format arms in the direction of the arrow A in FIG. 5. Since the format arms in the first portion 41*a*, 41*b* are situated at a great distance from one another, the connecting means occupy a position at a distance from one another, whereby the packing pocket or pockets 16 which are in a position corresponding to the position of the first portion 41*a*, 41*b* of the format arms will be accessible for the feeding in of goods. These goods, consisting of a number of items 50*a*–50*e*, are inserted successively into the pocket, each succeeding item pressing the foregoing item in the direction towards the bottom of the pocket. In each application the dimensions of the pocket 16 are chosen so that the inner cross-section of the pocket in the expanded state does not permit two items to be placed wholly or partly on top of one another. Similarly, the length of the pocket is adapted to the combined length of the items intended for a pocket in such a manner that the combined length of the items is only insignificantly less than the length of the pocket. Subsequently the joint 21 between the two walls is formed in the striplike area 19*a*, 19*b*, the joint being placed so that the distance to the nearest joint 15 arranged transversely to the longitudinal direction of the web is less than the smallest dimension of the items. In this manner any movement of items out of the pocket into which they have been introduced, after closure of the pockets, is prevented. The connecting means 17*a*, 17*b* together with any superfluous material in the striplike areas 19*a*, 19*b* are then severed from the package band filled with items and the package band 24 filled with goods has been formed.

When the package band 24 is to be emptied it is passed to the arrangement according to FIGS. 6–9. As a rule the package band is drawn by the transporting means 68*a*, 68*b* from the feeding-in part 80 of the arrangement to the discharge part 81 of the arrangement. At the start of the feeding in of the package band the second connecting means 18 are guided in position so as to cooperate with the retaining means 64. At the same time the front control means 66 is introduced into the closed package band up to the closure 21 and occupies there a position alongside the package band between the two walls 11*a*, 11*b* in the region of the striplike area 19*a*, 19*b*. The retaining means 64 and the front control means 66 ensure that the package band is extended transversely to the longitudinal direction of the track. During the continued travel of the package band in the direction towards the second end area 76 of the discharge base, the second cutting device 67 opens the package band adjoining the joint 21 which was formed while closing the package band. As a result an opening 25 is formed for each of the pockets 16 to allow goods which are stored in them to leave the pockets.

In applications where the goods stored in the pockets have a shape which could cause the control means 66 to stick to the goods, as a rule the first edge area 12 of the closed package band 24 is provided with a connecting means e.g. a tunnel or material thickenings which interacts with the control means. Preferably the connecting means is made in connection with the closing of the filled package band, e.g. by means of the welding dies 33, 34.

When the first pocket 16 with components reaches the position adjacent to the receiving means 82 (receiving board or receiving track 62) the contact means 74 of the discharging device is moved transversely to the longitudinal direction of the package band whilst resting against the second wall 11*b* of the package band which in turn is pressed by the contact means against an edge or wall of the component stored in the pocket farthest from the opening of the pocket, the edge or wall facing towards the contact means. As a result the components are pushed out of the pocket by the contact means and are placed on the receiving board 62. When the package band has been advanced one position, the next pocket is emptied of its contents. In certain applications the discharge of components is controlled with a view to the presence, or the number, of components on the receiving board. In certain applications the presence of components on the receiving board is monitored by means of a detector arrangement, the discharge from a pocket taking place only when no components are present on the receiving board or when a number of components specified in advance has been recorded on the receiving board.

During the movement towards the discharge end of the arrangement the connecting means 18 located in the second edge area 14 of the package band passes the first cutting means 65 which opens the connecting means 18. This makes it possible for the band to leave the retaining means 64. The band, thereafter, continues between the two displacement means 68*a*, 68*b* and the used band is stored in a container 61.

In some embodiments of the package band one or more of the connecting means 17*a*, 17*b* or 18 are constituted as material thickenings. During the filling and/or emptying of the pockets 16 the walls of the package band in such cases pass through slits e.g. in the walls of pipes. The width of the slits in such cases is chosen so that the material thickenings are hindered from slipping out of the slits. In such embodiments of the arrangement, the retaining means 64 or control means 66 are provided with slits and are thus adapted to the package band described above.

In certain applications of the invention the discharge base 60, as mentioned already, is designed with, or as a, conveyor belt against which rests the first wall 11*a* of the package band. The conveyor belt then completes and/or substitutes the transporting arrangement 68*a*, 68*b* for the package band. This embodiment is particularly appropriate to be used when the package band contains relatively heavy goods.

The foregoing detailed description has made reference only to a limited number of embodiments of the invention, but it will be obvious to those versed in the art that the invention encompasses a great number of embodiments within the framework of the following claims.

We claim:

1. A method for discharging articles from the pockets of a package which extends longitudinally and has first and second facing walls of flexible material joined together at opposite edges and provided with spaced transverse joints forming the pockets in a succession lengthwise of the package, said method comprising advancing the package longitudinally with one of said walls resting on a support base, the package being advanced on said support base so that successive pockets move past a work station, cutting the package so that each pocket is formed with an opening near one of said opposite edges when the pocket is at said work station, holding the package relative to the support base to prevent transverse movement of the package, moving a discharge device at the work station transversely of the package and lengthwise of the pocket towards the opening therein while pressing the discharge device against the other of said walls so that as the discharge device travels along the pocket towards said one edge from the other edge, the walls of the package are moved closer together and pressed against said support base to discharge the articles from the pocket through said opening.

2. A method as claimed in claim 1 wherein the package is held relative to the support base by engaging a support arm on the base in a receiving opening in said package extending longitudinally thereof.

3. A method as claimed in claim 2 comprising locating said support arm at the edge of said package remote from the edge rear which said opening is formed for the discharge of the articles.

4. A method as claimed in claim 2 wherein said package is longitudinally advanced by drivingly engaging the package downstream of the work station.

5. A method as claimed in claim 1 comprising cutting the package at the other edge thereof after the articles have been discharged from the pocket.

6. A method as claimed in claim 5 wherein the cutting of the package at said other edge is effected downstream of the work station.

7. A method as claimed in claim 1 wherein the opening in the pocket of the package is formed before each of the pockets reaches the work station.

8. A method as claimed in claim 1 wherein the discharge device is moved lengthwise of the pocket by rolling transversely along the package.

9. A method as claimed in claim 1 wherein a number of solid articles are arranged in a line along said pocket and said discharge device pushes against the last article in the line to discharge the articles in succession one after another through said opening.

10. A method as claimed in claim 9 wherein the articles travel on said one wall of the package which rests on the support base as said articles are advanced along the pocket for discharge from said opening.

11. A method as claimed in claim 1 wherein said discharge device is moved lengthwise of said pocket beginning near said edge.

* * * * *